US007205971B2

(12) United States Patent
Baek et al.

(10) Patent No.: US 7,205,971 B2
(45) Date of Patent: Apr. 17, 2007

(54) DRIVING CIRCUIT OF A LIQUID CRYSTAL DISPLAY DEVICE FOR ELIMINATING RESIDUAL IMAGES

(75) Inventors: Heum-Il Baek, Seoul (KR); Mi-Sook Nam, Suwon (KR)

(73) Assignee: LG.Philips LCD Co., Ltd., Seoul (KR)

( * ) Notice: Subject to any disclaimer, the term of this patent is extended or adjusted under 35 U.S.C. 154(b) by 430 days.

(21) Appl. No.: 10/160,037

(22) Filed: Jun. 4, 2002

(65) Prior Publication Data

US 2002/0186194 A1 Dec. 12, 2002

(30) Foreign Application Priority Data

Jun. 11, 2001 (KR) ..... 2001-32454

(51) Int. Cl.
*G09G 3/36* (2006.01)

(52) U.S. Cl. ..... 345/98; 345/87; 345/88; 345/29; 345/213; 345/214

(58) Field of Classification Search ..... 345/50, 345/55, 87–102, 211–215
See application file for complete search history.

(56) References Cited

U.S. PATENT DOCUMENTS 5,105,288 A * 4/1992 Senda et al. ..... 345/87
5,793,346 A * 8/1998 Moon ..... 345/92
6,201,522 B1 * 3/2001 Erhart et al. ..... 345/96
6,304,256 B1 * 10/2001 Nagaya ..... 345/211
6,518,947 B1 * 2/2003 Kim ..... 345/100
6,621,489 B2 * 9/2003 Yanagisawa et al. ..... 345/211
6,924,782 B1 * 8/2005 Fujioka et al. ..... 345/92
2002/0041279 A1 * 4/2002 Chou ..... 345/211
2003/0038768 A1 * 2/2003 Sakashita ..... 345/87

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

A driving circuit of a liquid crystal display device includes gate and data lines, a thin film transistor connected to the gate and data lines, and a liquid crystal capacitor connected to the thin film transistor. The driving circuit includes a gate driving unit for generating a gate signal applied to the gate line, a source driving unit for generating a data signal applied to the data line, a gamma power source unit for applying a gamma reference voltage to the source driving unit, a common voltage unit for applying a common voltage to the liquid crystal capacitor, a discharging signal unit for generating a discharging enable signal when a power of the liquid crystal display device is off, and a multiplexer, connected to the common voltage unit and the gamma power source unit, for selectively applying a voltage to the source driving unit according to the discharging enable signal.

14 Claims, 7 Drawing Sheets

DRIVING CIRCUIT OF A LIQUID CRYSTAL DISPLAY DEVICE FOR ELIMINATING RESIDUAL IMAGES

This application claims the benefit of Korean Patent Application No. 2001-32454, filed on Jun. 11, 2001, which is hereby incorporated by reference for all purposes as if fully set forth herein.

BACKGROUND OF THE INVENTION

1. Field of the Invention

The present invention relates to a driving circuit of a liquid crystal display (LCD) device, and more particularly to a driving circuit of a reflective or transflective LCD device.

2. Discussion of the Related Art

Flat panel display (FPD) devices have been the subject of recent research due to their small size, light weight, and low power consumption. Among FPD devices, LCD devices are most widely used because of their excellent resolution, color display range, and other display quality characteristics. LCD devices typically comprise first and second substrates, wherein each substrate supports respective electrodes that face each other, and a liquid crystal layer is interposed between the first and second substrates. Due to an electric field generated by a voltage applied to the respective electrodes, the liquid crystal layer exhibits optical anisotropy. Using optical transmittance differences defined by the optical anisotropy, LCD devices may be used to display images.

In general, LCD devices include driving devices to drive the liquid crystal layer interposed between first and second substrates.

LCD devices are non-emissive display devices and therefore require a light source. Depending on whether the display device requires an internal or external light source, LCD devices may be defined as transmissive LCD devices and reflective LCD devices, respectively.

Transmissive LCD devices include an LCD panel and an internal light source provided as a backlight device. By selectively adjusting an alignment of the liquid crystal layer, the LCD panel may display images by selectively adjusting the transmittance of light emitted by the backlight through the LCD panel. Accordingly, the first and second substrates are transparent substrates and the respective electrodes may be formed of transparent conductive material. Transmissive LCD devices are capable of displaying bright images in darkened environments due to the presence of the backlight, however, power consumption of the transmissive LCD is increased due to operation of the backlight device.

Reflective LCD devices include a first substrate that supports a first electrode formed of transparent conductive material to allow for the passage of the ambient light, and a second electrode formed of conductive material of high reflectance. By selectively adjusting the alignment of the liquid crystal layer, as discussed above, the LCD panel may display images by selectively adjusting the transmittance of ambient or artificial external reflected light. Since reflective LCD devices use external or ambient light to display images, power consumption characteristics of reflective LCD devices are relatively low compared with the that of transmissive LCD devices. However, reflective LCD devices are not easily viewed in darkened environments.

Due to the limitations of the transmissive and reflective LCD devices described above, transflective LCD devices, capable of being selectively viewed in either of the aforementioned transmissive or reflective modes at the user's discretion, are currently the subject of research and development.

FIG. 1 illustrates a schematic plan view of an LCD device with a driving device.

Referring to FIG. 1, an LCD panel 10 includes an array substrate 11 and a color filter substrate 12. A liquid crystal layer (not shown) is interposed between the array and color filter substrates 11 and 12, respectively. Since the array substrate 11 has a larger area than the color filter substrate 12, a portion of the array substrate left is left uncovered by the color filter substrate 12. This uncovered portion supports a pad (not shown) that is used for applying a signal to a line of the LCD panel 10. The pad is connected to a tape carrier package (TCP) 30 including gate and source driving integrated circuits (ICs) 31 used for driving the LCD panel 10. The TCP 30 is also connected to a printed circuit board 20 (PCB), on which a plurality of devices are formed, and from which various control and data signals are generated. The TCP 30 is formed in a packaging method that connects the driving ICs 31 to the LCD panel 10. The TCP 30 may include a flexible film capable of being bent towards a rear surface of the LCD panel 10, with a driving IC 31 mounted thereon. Since the driving ICs are mounted on the flexible film, the LCD device may be made compactly. Alternatively, the driving ICs may be connected to the LCD panel 10 using either chip on glass (COG) or chip on film (COF) methods. Using the COG method, the driving ICs are mounted to the array substrate 11 and the volume of the LCD device increases relative to the volume of the LCD device employing TCP. Similar to the TCP method, COF methods mount driving ICs to an extra film, thereby creating a compact structure. Accordingly, TCP or the COF methods are typically used over COG methods.

The array substrate 11 includes a pixel electrode and a TFT for applying a signal to the pixel electrode. The color filter substrate 12 includes a color filter layer and a common electrode. The pixel electrode of the array substrate 11 includes a liquid crystal capacitor connected to the common electrode of the color filter substrate 12. A storage capacitor may be connected to the liquid crystal capacitor to maintain an applied voltage until a subsequent signal is applied. Accordingly, a leakage current between the pixel and common electrodes may be reduced when a voltage is applied to the liquid crystal capacitor. Storage capacitors further provide other advantages such as increasing gray level stability, reducing flicker, and reducing residual images.

FIG. 2 illustrates an equivalent circuit diagram of one pixel of an LCD device having a storage capacitor.

Referring to FIG. 2, a pixel including a TFT 53, a liquid crystal capacitor 54 ($C_{LC}$), and a storage capacitor 55 ($C_{st}$) may be defined at crossings of gate and data lines 51 and 52, respectively. The TFT 53 includes gate "G", source "S" and drain "D" terminals connected to gate and data lines 51 and 52, respectively. The TFT 53 switches data signals applied to the liquid crystal capacitor 54 on or off. The liquid crystal capacitor 54 and the storage capacitor 55 are connected parallel to each other and used as loads. A parasitic capacitance 56 (Cgs) is generated between the gate "G" and the source "S".

In a normal driving state, when "high" signals are applied to the gate "G", a channel of the TFT 53 is opened between the source "S" and the drain "D". Therefore, charge to and discharge from the liquid crystal capacitor 54 and the storage capacitor 55 may be performed through the source "S" and the drain "D". When power to the LCD device is turned off, power is not supplied to the gate "G" and the channel is closed. When the channel is closed, load charges are not discharged through the channel but are gradually discharged through the parasitic capacitance between the gate "G" and the source "S" and a leakage current of the channel. Therefore, undesirable residual images may remain long periods of time, even after power to the LCD is turned off. For transmissive LCD devices, residual images are not displayed because power supplied to the backlight device is also turned off. However, for reflective or transflective LCD devices, residual images remain because reflective LCD and transflective LCD devices use ambient light as a light source.

FIGS. 3A and 3B illustrate plan views of a reflective LCD device before and after a power is off, respectively. The reflective LCD device exhibits a normally white mode, in which a white is displayed when a voltage is not applied.

Referring to FIGS. 3A and 3B, discharge occurs from the center of the LCD panel after power to the LCD device is turned off and radiates to the edges of the LCD panel. Accordingly, image erasure originates at the center of the LCD panel and radiates towards the edges of the panel. When power of reflective or transflective LCD devices is turned off, the channel of a TFT is closed by the gate and residual charges of a LCD panel are not discharged. Accordingly, undesirable residual images remain.

SUMMARY OF THE INVENTION

Accordingly, the present invention is directed to a liquid crystal display device that substantially obviates one or more of problems due to limitations and disadvantages of the related art.

An advantage of the present invention is to provide a driving circuit of a liquid crystal display device to eliminate residual images by discharging stored charges of a pixel after power to the pixel is turned off.

Additional features and advantages of the invention will be set forth in the description that follows, and in part will be apparent from the description, or may be learned by practice of the invention. Other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device including gate and data lines; thin film transistors connected to the gate and data lines; liquid crystal capacitors connected to the thin film transistors, and voltages applied to the liquid crystal capacitors from the thin film transistors further includes a driving circuit; wherein the driving circuit includes a gate driving unit for generating a gate signal applied to the gate line; a source driving unit for generating a data signal applied to the data line; a gamma power source unit for applying a gamma reference voltage to the source driving unit; a common voltage unit for applying a common voltage to the liquid crystal capacitor; a discharging signal unit for generating a discharging enable signal when a power of the liquid crystal display device is off; and a multiplexer, connected to the common voltage unit and the gamma power source unit, for selectively applying a voltage to the source driving unit according to the discharging enable signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included herewith to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, similar reference numbers will be used throughout the drawings to refer to the same or like parts.

Figure 1:
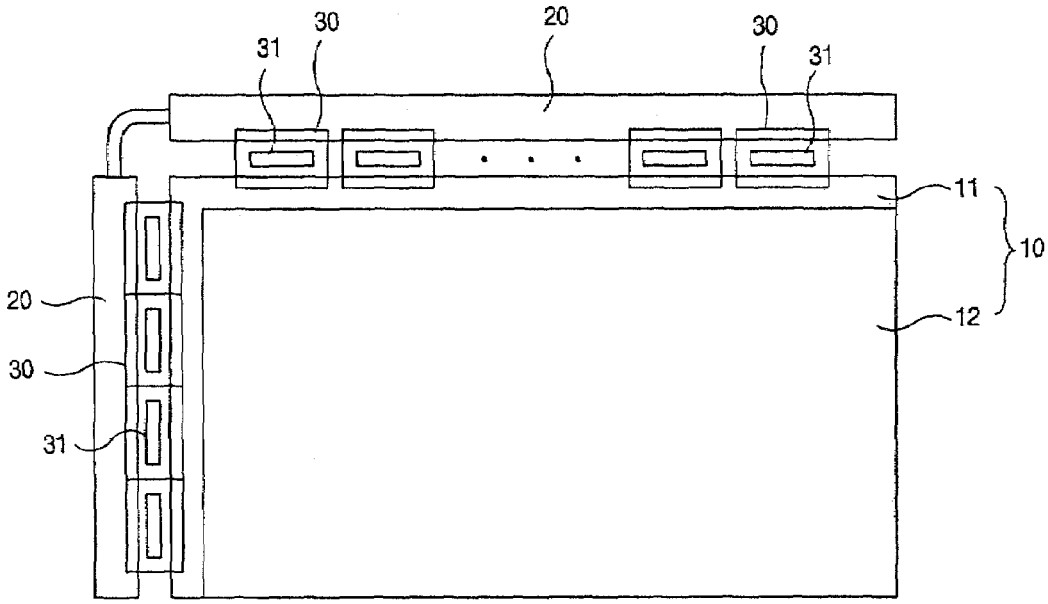
(related art) FIG. 1
FIG. 1 illustrates a schematic plan view of an LCD device having a driving part.
Figure 2:
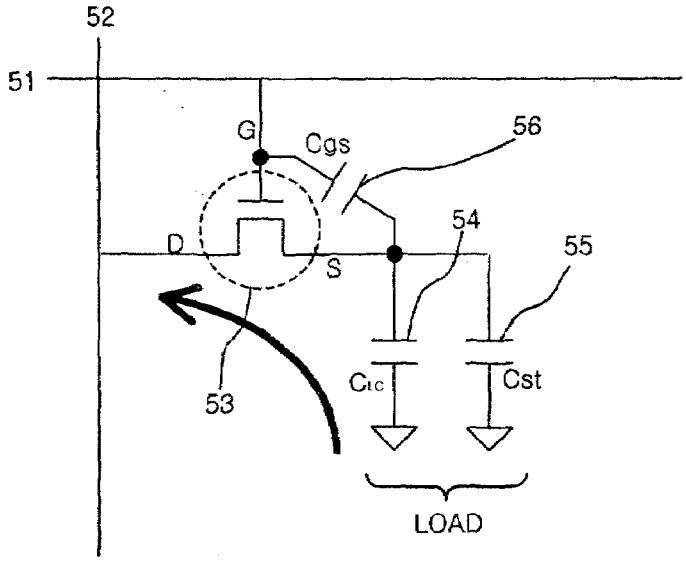
(related art) FIG. 2
FIG. 2 illustrates an equivalent circuit diagram of one exemplary pixel of the LCD device having a storage capacitor.
Figure 3A:
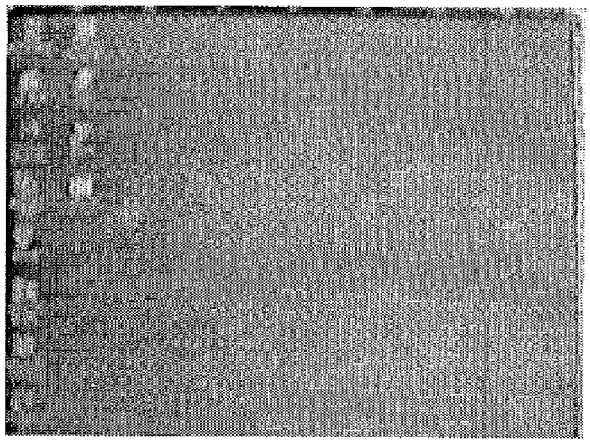
(related art) FIG. 3A
FIGS. 3A and 3B illustrate plan views of a reflective LCD device before and after a power is off, respectively.
Figure 3B:
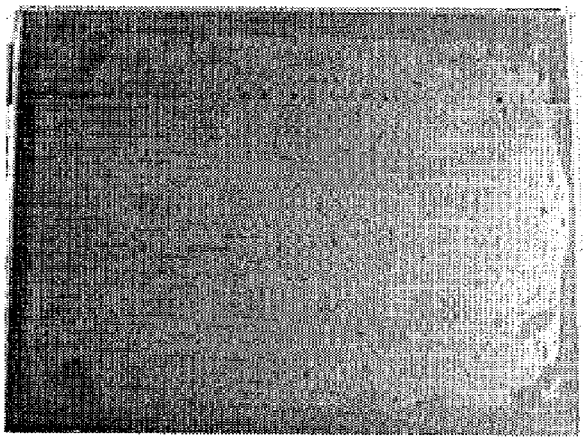
(related art) FIG. 3B
Figure 4:
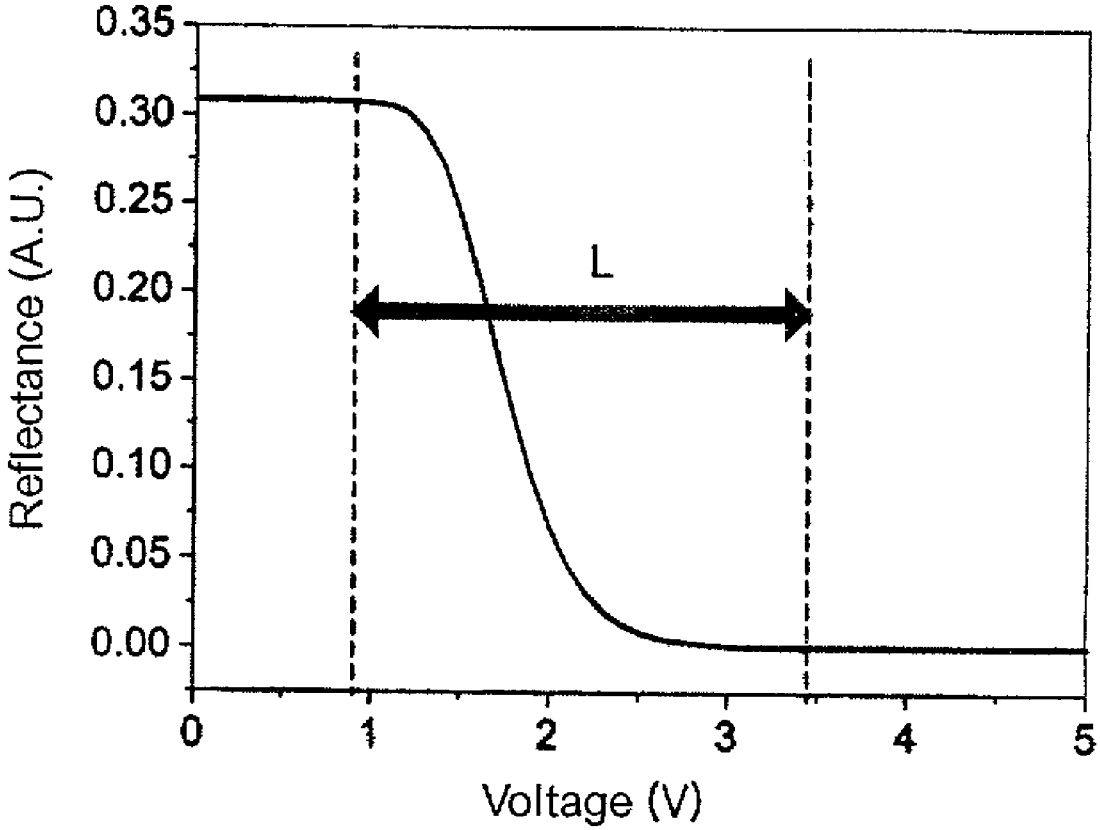
(related art) FIG. 4
FIG. 4 illustrates a V-R curve of a reflective portion of a transflective LCD device plotting reflectance as a function of applied voltage.

FIG. 4 illustrates a schematic V-R curve at a reflective portion of a normally white mode transflective LCD device, plotting reflectance as a function of applied voltage.

In digitally driving the LCD device, a gamma reference voltage of a source driving integrated circuit (IC) needs to be determined. As shown in FIG. 4, linearity of the gamma reference voltage is provided when a driving voltage within a specific range "L" is selected as the gamma reference voltage.

Figure 5:
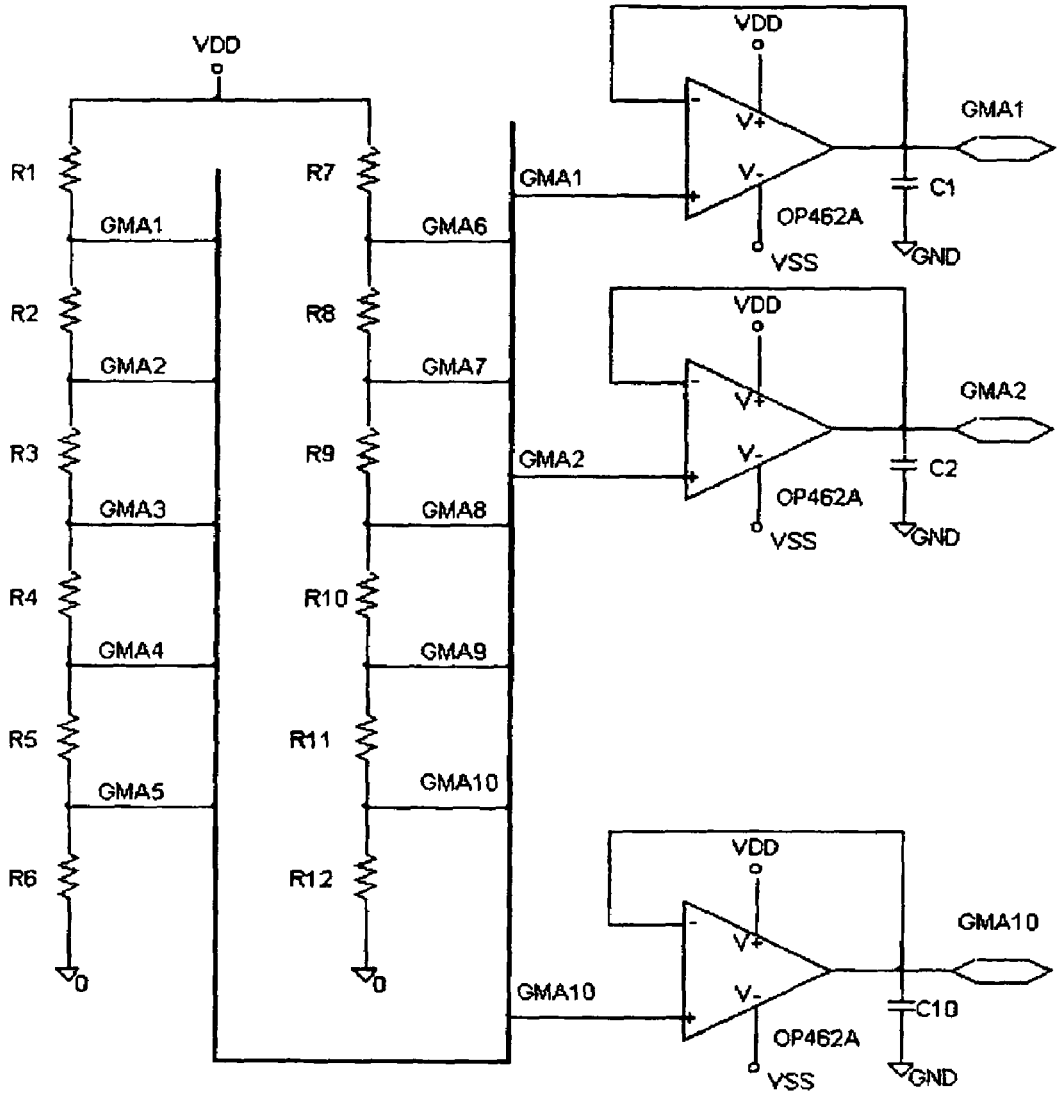
FIG. 5 illustrates a circuit diagram of a gamma power source unit for an LCD device.

FIG. 5 illustrates a circuit diagram gamma power source unit used in a normally white mode LCD device driven by a dot inversion method in which right, left, upper and lower pixels have an opposite polarity.

Referring to FIG. 5, a high input voltage "VDD" is to distributed resistors "R1" to "R12" connected in series to generate ten gamma reference voltages "GMA1" to "GMA10". Gamma reference voltages "GMA1" to "GMA10" are transferred to a source driving unit (not shown) through OP Amps "OP462A" and applied to a liquid crystal capacitor as driving voltages for a liquid crystal layer.

Figure 6:
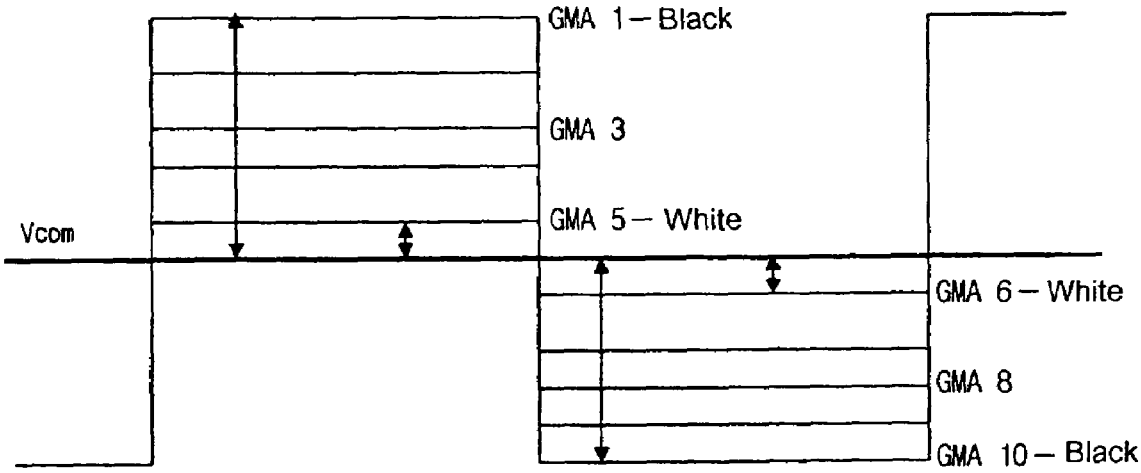
FIG. 6 illustrates a wave shape of a driving voltage generated from a gamma power source unit of FIG. 5.
Figure 6:
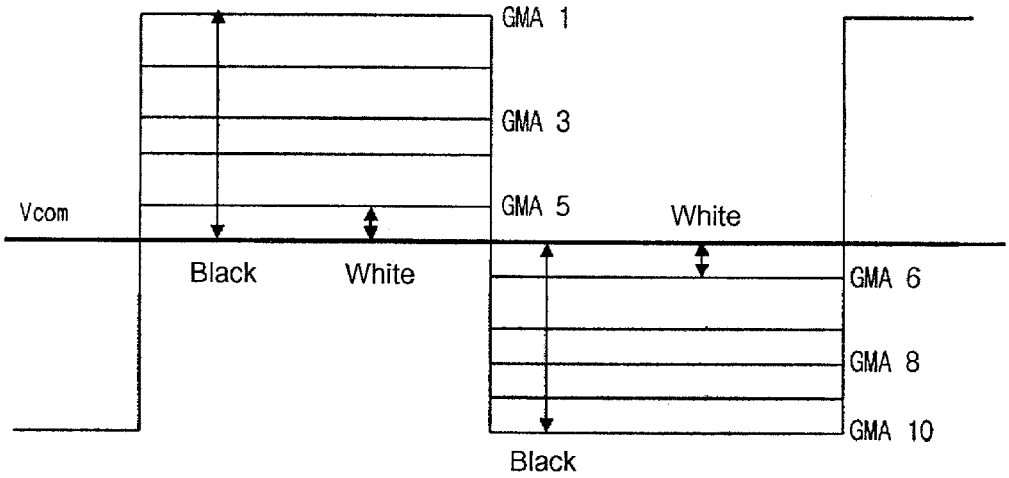
(related art) FIG. 6

FIG. 6 illustrates a wave shape of a driving voltage generated from a gamma power source unit of FIG. 5.

Referring to FIG. 6, gamma reference voltages may be classified into five positive values ("GMA1" to "GMA5") and five negative values ("GMA6" to "GMA10"), with respect to a common voltage "Vcom". When the LCD device displays a black image, the values of the gamma reference voltages are at their highest or lowest magnitudes, e.g., "GMA1" or "GMA10". When the LCD device displays a white image, the values of the gamma references are at medium magnitudes, e.g., "GMA5" or "GMA6".

To eliminate residual images by discharging pixels in an LCD device, a gate-high voltage is applied to a gate terminal of a TFT so that a common voltage can be applied to a source terminal of the TFT while a channel of the TFT is open. Therefore, for an LCD device of a normally white mode, a white image is displayed while the channel is open. As shown in FIG. 6, reference voltages displaying white image have medium values "GMA5" or "GMA6". Accordingly, these medium value reference voltages are different from the common voltage "Vcom". As the voltage difference between two terminals increases, discharge of the pixel through two terminals becomes easier. Accordingly, the time required to discharge an LCD device using "GMA5" or "GMA6" is longer than that of an LCD device using "Vcom". Further, incomplete discharging may be encountered using "GMA5" or "GMA6".

Figure 7:
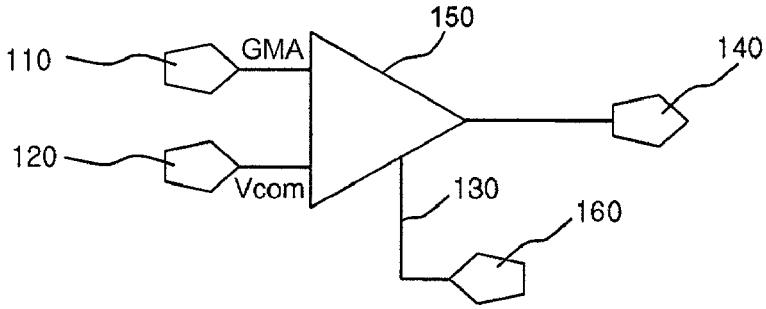
FIG. 7 conceptually illustrates a circuit capable of eliminating residual images according to an embodiment of the present invention.

FIG. 7 conceptually illustrates a circuit capable of eliminating residual images, according to an embodiment of the present invention.

Referring to FIG. 7, a circuit capable of eliminating residual images includes a multiplexer 150 (MUX) connected to a gamma power source unit 110 and a common voltage unit 120. The MUX 150 transfers one of a gamma reference voltage "GMA" and a common voltage "Vcom" to a source driving unit 140 according to a discharging enable signal 130 of a discharging signal unit 160. The gamma power source unit 110 has the structure described with reference to FIG. 5 and generates the gamma reference voltage "GMA". Moreover, the common voltage unit 120 generates the common voltage "Vcom" applied to a liquid crystal capacitor. In displaying a white image, the discharging enable signal 130 is set to 0, i.e., power to the LCD device is turned on, and the MUX 150 selects one gamma reference voltage corresponding to a white image, e.g., "GMA5" or "GMA6", from the gamma power source unit 110. Subsequently, the MUX 150 transfers the selected gamma reference voltage to the source driving unit 140 as a white gamma voltage. When the discharging enable signal is 1, i.e., power to the LCD device is turned off, the MUX 150 selects and transfers the common voltage "Vcom" from the common voltage unit 120 to the source driving unit 140 and applies a gate-high signal to a gate terminal to open a channel of a TFT (not shown).

Figure 8:
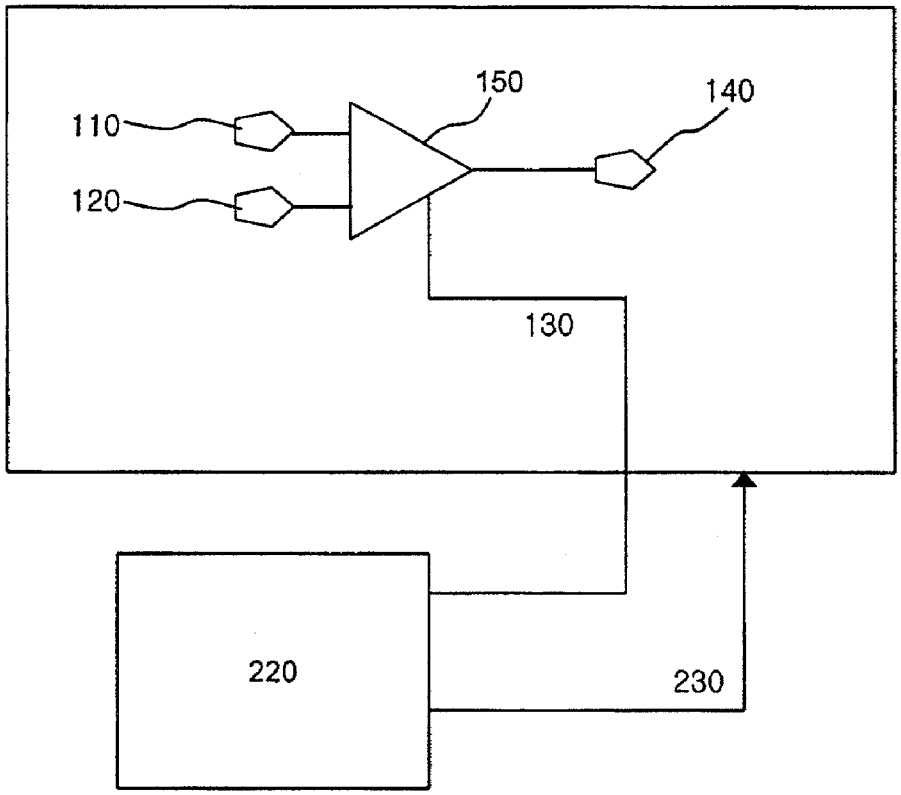
FIG. 8 illustrates a process of eliminating residual images while power to the LCD device is turned off.
Figure 9:
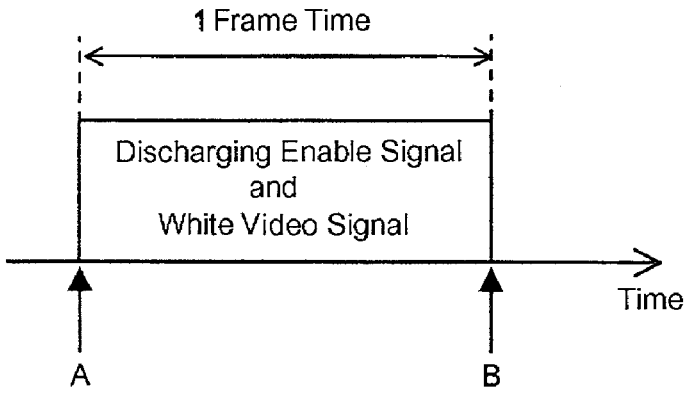
FIG. 9 illustrates a timing chart of a process for eliminating residual images.

FIG. 8 illustrates a process of eliminating residual images while power to an LCD device is turned off and FIG. 9 illustrates a timing chart of a process for eliminating residual images.

Referring to FIG. 8, a system 220 includes a discharging signal unit (not shown) and a gate signal unit (not shown). When a power switch of the system 220 is off, the system generates a discharging enable signal 130 at the discharging signal unit (not shown), a white video signal 230, and a gate-high signal at the gate signal unit for one frame period. If the LCD device is driven at 60 Hertz (Hz), one frame period is 1/60 seconds (sec.). The gate-high signal is sequentially applied to each of the gate lines of the LCD device thereby opening the channel of the TFT. Simultaneously, a common voltage selected by a MUX 150 is applied to data lines through the source driving unit 140. Accordingly, all charges stored in the liquid crystal capacitors are discharged through the channel, effectively turning off power to the LCD device.

As shown in FIG. 9, at a first time period, "A", the power switch of the system is off and at a second time period, "B", the power to the LCD device is off within one frame period.

Consequently, a driving circuit of a reflective or transflective LCD device includes a circuit for eliminating residual images connected to a gamma power source unit and a common voltage unit. All charges stored in pixels may be completely eliminated by selectively applying a gamma reference voltage or a common voltage to pixels of the LCD device according to a discharging enable signal. Accordingly, undesirable residual images, conventionally present after power to the LCD device is turned off, may be removed without greatly changing the driving circuit.

It will be apparent to those skilled in the art that various modifications and variations can be made in the method of manufacturing a flat panel display device of the present invention without departing from the spirit or scope of the invention. Thus, it is intended that the present invention cover the modifications and variations of this invention provided they come within the scope of the appended claims and their equivalents.

What is claimed is:

1. A driving circuit of a liquid crystal display device, the liquid crystal display device comprising gate and data lines, a thin film transistor connected to the gate and data lines and a liquid crystal capacitor connected to the thin film transistor, wherein a voltage is applied to the liquid crystal capacitor from the thin film transistor, the driving circuit comprising:

a gate driving unit to generate a gate signal to be applied to the gate line;

a source driving unit to generate a data signal to be applied to the data line; a gamma power source unit to generate a gamma reference voltage;

a common voltage unit to generate a common voltage to the liquid crystal capacitor;

a discharging signal unit to generate a discharging enable signal having a value corresponding to whether a power of the liquid crystal display device is on or off; and a multiplexer to select between connecting a voltage of the common voltage unit to the source driving unit and connecting a voltage of the gamma power source unit to the source driving unit according to the discharging enable signal.

2. The driving circuit according to claim 1, wherein the discharging enable signal is one of 0 and 1.

3. The driving circuit according to claim 2, wherein the multiplexer applies the gamma reference voltage or the common voltage to the source driving unit when the discharging enable signal is 0 or 1, respectively.

4. The driving circuit according to claim 3, wherein the common voltage is applied to the source driving unit for one frame period.

5. A method of driving a liquid crystal device, the liquid crystal display device comprising gate and data lines, a thin film transistor connected to the gate and data lines and a liquid crystal capacitor connected to the thin film transistor, wherein a voltage is applied to the liquid crystal capacitor from the thin film transistor, the method comprising:

applying a gate signal to the gate line;

applying a data signal to the data line;

applying a common voltage to the liquid crystal capacitor;

generating a discharging enable signal having a value corresponding to whether a power of the liquid crystal display device is on or off; and selecting between applying a gamma reference voltage to the source driving unit and applying a common voltage to the source driving unit according to the discharging enable signal.

6. The method according to claim 5, wherein the discharging enable signal is one of 0 and 1.

7. The method according to claim 6, wherein the gamma reference voltage or the common voltage is applied to the source driving unit when the discharging enable signal is 0 or 1, respectively.

8. The method according to claim 7, wherein the common voltage is applied to the source driving unit for one frame period.

9. A method of eliminating residual images in a liquid crystal display device, comprising:

providing a multiplexer;

connecting a gamma power source unit to the multiplexer;

connecting a common voltage unit to the multiplexer; and providing a discharging signal unit for sending a discharging signal corresponding to the liquid crystal display device being turned off, wherein the multiplexer selects between transferring a gamma reference voltage to a source driving unit and transferring a common voltage to a source driving unit according to the discharging enable signal.

10. The method according to claim 9, further comprising applying the common voltage to a liquid crystal capacitor.

11. The method according to claim 9, wherein the discharging enable signal is 0 and the multiplexer selects a gamma reference voltage according to a white image.

12. The method according to claim 11, further comprising transferring the selected gamma reference voltage to the source driving unit.

13. The method according to claim 9, wherein the discharging enable signal is 1 and the multiplexer selects a common voltage.

14. The method according to claim 13, further comprising transferring the selected common voltage to the source driving unit.

* * * * *